United States Patent [19]

Yoder

[11] Patent Number: 4,690,404

[45] Date of Patent: Sep. 1, 1987

[54] TAGGING STICK

[76] Inventor: Jerry L. Yoder, 4076 County Rd. 27, Auburn, Ind. 46706

[21] Appl. No.: 812,173

[22] Filed: Dec. 23, 1985

[51] Int. Cl.[4] ..... A63B 59/00

[52] U.S. Cl. ..... 273/67 R; 446/213; 446/418; 273/DIG. 8

[58] Field of Search ..... 446/402, 418, 421, 422, 446/213, 215; 231/2, 4 R; 273/1 F, 67 R; D25/74, 78; 272/68

[56] References Cited

U.S. PATENT DOCUMENTS

| | | | |
|---|---|---|---|
| 3,921,978 | 11/1975 | Warren | 273/67 R |
| 4,079,936 | 3/1978 | Schachter | 273/67 R |
| 4,328,966 | 5/1982 | Miyamoto | 273/1 F |

OTHER PUBLICATIONS

"Family Weekly" Publication, p. 15, Dec. 21, 1975.

*Primary Examiner*—Richard C. Pinkham
*Assistant Examiner*—Gary Jackson
*Attorney, Agent, or Firm*—Jeffers, Hoffman & Niewyk

[57] ABSTRACT

A tagging stick has a long, solid, rod-like, cylindrical body composed of resiliently flexible cellular foam material, such as polyurethane foam, being stiff enough to allow grasping and swinging by a human without bending but soft enough to permit striking objects and human bodies. The stick body has an exterior surface configured to form a plurality of pockets of air which, upon impact of the body against an object, cause compression of the air and production of loud popping sounds. Preferably, the body surface which defines the air pockets has an undulating configuration composed of alternating ridges and troughs with respect to a cross section along a longitudinal axis of the body.

17 Claims, 5 Drawing Figures

TAGGING STICK

BACKGROUND OF THE INVENTION

1. Field of the Invention

The present invention generally relates to objects useful in playing games and, more particularly, is concerned with a tagging stick designed to permit body contact in many contact games involving younger players by allowing an alternative to using their hands or other devices, thereby permitting harmless hitting of the stick against the players and to further provide a tagging stick which produces loud popping noises likely to interest the young players in utilizing the tagging stick.

2. Description of the Prior Art

Conventional wisdom suggests that physical contact between players and objects, such as balls, with the players is an essential ingredient for a game to be fun. Widespread popularity of the so-called "act" sports attests to the prevalence of this point of view. However, satisfaction gained from participation in such sports is accompanied by a relatively high risk of physical injury to the participants. The probability and seriousness of physical injury is accentuated when such contact games involve younger players, such as youngsters in their preteen years, primarily because of the immaturity of their physical development and motor skills.

Many games played by youths in these age groups incorporate a body tagging feature, applied either by the hand of a participant or by a thrown or kicked object, such as a particle-filled bag commonly called a bean bag or a pressurized ball referred to as kick ball. While involving less risk of bodily injury than the major contact sports, these tagging games still carry a significant risk that, whether by accident or a deliberate act, sufficient contact will be applied to cause serious injury. Therefore, the desirability of finding an alternative which reduces the opportunity for harmful physical contact in these younger age groups is readily apparent.

Consideration has been given heretofore to designing devices which are soft and may, therefore, be used in tagging type games. Some specific examples in the prior art of such tagging devices are a round foam ball called a Nerf ball, a large cylindrical vinyl-covered foam bat gripped by both hands being marketed under the Com-Bat tradename, a pillow-soft club-like cylindrical device with a molded grip and padded handguard called a Bataca Bat, a large cylindrical foam bat with an enclosed handgrip named a Deluxe Encounter Bat and a soft and pliable foam duelling sword identified as a Boffer sword. While the intentions behind all of these devices are commendable, they appear to be capable of use only in a few different ways. Thus, they are unlikely to capture and hold the interest of the broad population of youngsters and would probably only be used infrequently and then only for short durations. Furthermore, and more importantly, these devices are not capable of producing loud popping noises despite the fact that the toy is soft, lightweight, and pliable.

Consequently, a need still exists for a tagging device which, while soft, is safer to use and is capable of being used in a wide variety of different ways by youngsters and is able to produce loud noises and, therefor, having universal appeal to them in order to ensure its acceptance as the medium of contact which will be used in their games.

SUMMARY OF THE INVENTION

The present invention provides a tagging stick designed to satisfy the aforementioned needs. The tagging stick is a long, solid, slender, cylindrical device composed of resiliently flexible cellular foam material, such as polyurethane foam, being rigid enough to grasp in the hand and swing without bending but soft enough to safely hit against objects or human bodies. The tagging stick is also configurated to form peripheral air pockets which, upon impact, produce harmless loud popping sounds. Also, there are a multitude of different ways in which the stick can be used: as a tagging wand, tied in a knot and thrown like a ball, hit against objects to make loud noise, as a track baton, or as an aid in exercising. The device may also be used as a spirit stick by fans during sporting events whereby the fans can demonstrate their team support by twirling their batons in the air or striking them against bleachers to make loud popping sounds. The devices may also be produced in various colors and have designs applied thereto to indicate school colors, mascots, and the like. The unexpected loud popping noises produced by the tagging stick are sure to excite youngsters and thus capture and hold their imagination and interest and promote continued use of the stick in their contact games.

Accordingly, the present invention is directed to a tagging stick comprising a long, rod-like body composed of resiliently flexible cellular foam material being stiff enough to allow grasping and swinging by a human hand without bending but soft enough to permit striking objects and human bodies. The body has an exterior surface being configured to form a plurality of pockets of air which, upon impact of the body against an object, cause compression of the air and production of loud sound such as popping noises.

Preferably, the body has an elongated cylindrical shape and its material is polyurethane foam. Also, the exterior body surface which defines the pockets, preferably, has an undulating configuration composed of alternating ridges and troughs with respect to a cross-section along a longitudinal axis of the body. In one embodiment, the ridges and troughs extend in transverse relationship about the body and alternate along the body. In another embodiment, the ridges and troughs spiral continuously about the body. Various parameters of the tagging stick, such as the depth and number of surface troughs and ridges, the tensile strength, density and cell count of the foam material, are specified to be within certain respective ranges.

These and other advantages and attainments of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
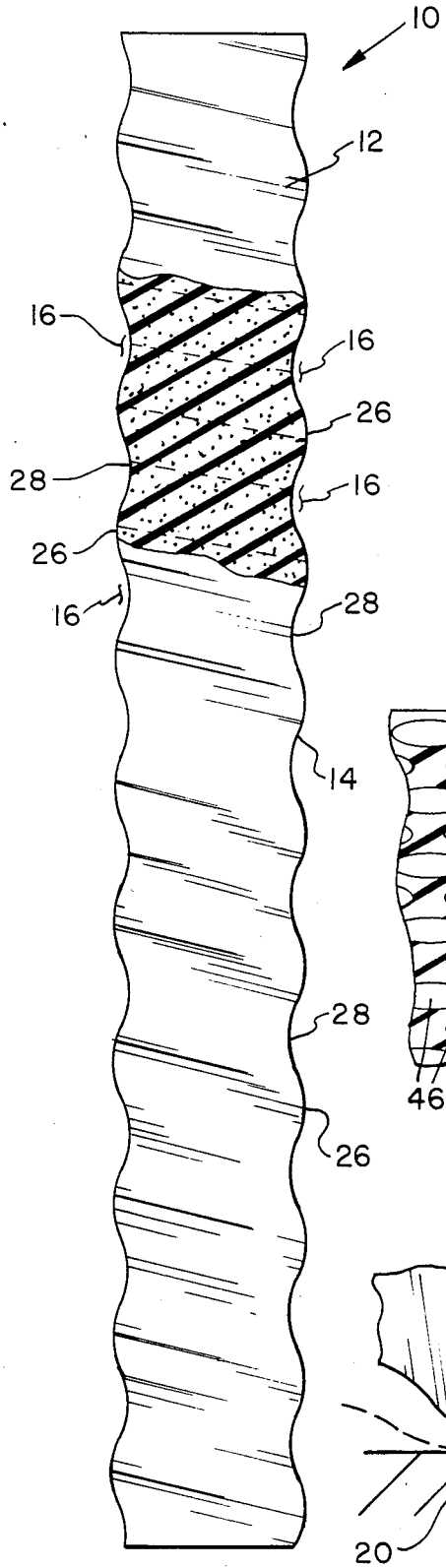
FIG. 1 is a side elevational view, partly sectioned, of a tagging stick constructed in accordance with the principles of the present invention and having a peripheral configuration of noise producing air pockets defined by ridges and troughs continuously spiraling about the exterior surface of the stick.

Referring now to the drawings, and particularly to FIG. 1, there is shown a tagging stick, generally designated by the numeral 10 and constituting the preferred embodiment of the present invention. The tagging stick 10 incorporates several features which make it uniquely well suited for use as a tagging device and attractive to youngsters to use as a substitute for other forms of physical contact.

One important feature of the tagging stick 10 is its long, solid, rod-like, cylindrical body 12 composed of a resiliently flexible cellular foam material. Parameters such as density and tensile strength are selected so that the material is neither too stiff nor too soft. On the one hand, the material of the body 12 is stiff enough so that it is not too floppy when gripped and swung or thrown at a target by a player using the stick 10 in a game. On the other hand, the body material is soft enough to permit hitting it against objects and human bodies.

Figure 4:
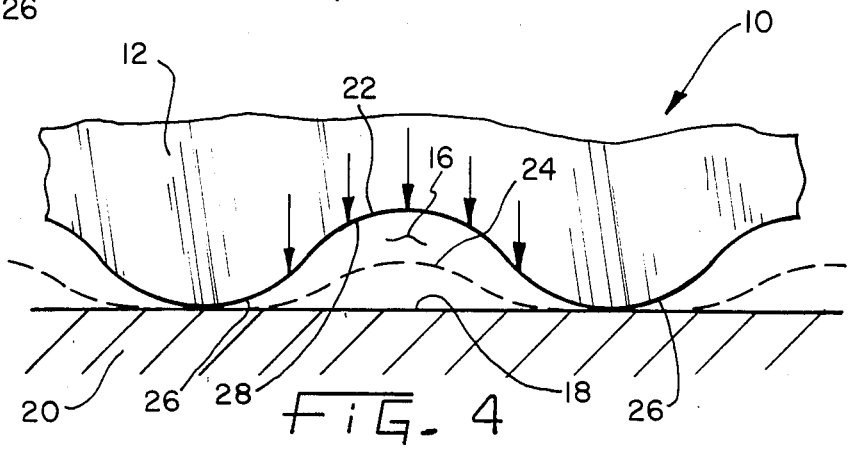
FIG. 4 is an enlarged diagrammatic representation of a portion of the tagging stick hitting the surface of an object and illustrating how air captured in one surface pocket thereof is compressed to produce sound.

Another important feature of the tagging stick 10 is its exterior surface, generally designated 14, which is suitably configured to form a plurality of noise-producing air pockets 16. Upon impact of the body 12 against the surface 18 of an object 20, as depicted in FIG. 4, air is captured in the pockets 16 and rapidly compressed as each pocket 16 engaged with the surface 18 decreases in size, from the larger volume contained under solid line 22 to the smaller volume contained under the dashed line 24, due to the direction of the force applied to the pocket 16, being indicated by the arrows in FIG. 4. The compressed air sets up acoustical vibrations which produce highly noticeable sounds, such as loud popping noises, that attract the attention and captivate the interest of youngsters.

Preferably, the air pockets 16 are defined by an undulating exterior surface configuration composed of alternating ridges 26 and troughs 28. In the embodiment of the tagging stick 10 of FIG. 1, its exterior body surface 14 has a spiraling continuous ridge and trough configuration. The inclination of the spiraling configuration is indicated by the dotted lines in FIG. 1 connecting the peaks of the continuous ridge 26 and valleys of the continuous trough 28 at opposite sides of the stick body 12.

Figure 5:
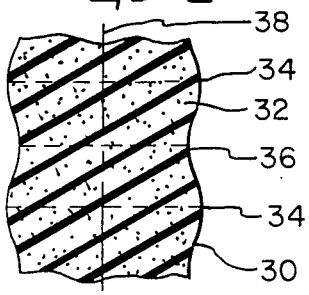
FIG. 5 is a longitudinal sectional view of a fragmentary portion of the tagging stick illustrating a modified configuration of the noise producing air pockets defined by ridges and troughs formed on the exterior surface of the stick to extend transversely to its longitudinal axis and in alternating relationship along its length.

An alternative form of the undulating exterior surface configuration is shown in FIG. 5. The exterior surface 30 of the stick body 32 is composed of ridges 34 and troughs 36 which extend about the body 32 transversely to the longitudinal axis 38 thereof and which alternate along the length of the body. The direction of the ridges 34 and troughs 36 is indicated by the dotted lines in FIG. 5 connecting the peaks of the ridges and valleys of the troughs at opposite sides of the stick body 32. Other surface configurations are possible such as, for instance, a dimpled outer surface of stick 10, since the particular shape of the undulations forming the air pockets is not critical. While stick 10, in the preferred embodiment is shown as cylindrical in shape, other configurations would also be suitable if supplied with an exterior surface having air pockets therein.

Figure 3:
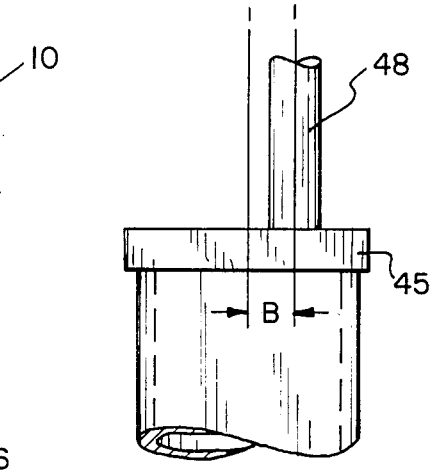
FIG. 3 is a diagrammatic representation of a hollow drilling mandrel and a block of foam material from which the tagging stick of FIG. 1 is cut by using the mandrel.
Figure 2:
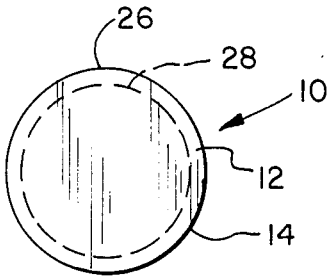
FIG. 2 is a top plan view of the tagging stick of FIG. 1.

FIG. 3 depicts one of several suitable ways to fabricate the stick 10. A hollow tubular bit 40 which includes a leading cutting edge 42 on its leading surface 43 which is formed at an angle, preferably of about 65 degrees, to the horizontal is used to drill out the stick. Specifically, as indicated by the arrows on the bit 40, it is rotated simultaneously as it is advanced toward a block of foam material 44 from which the tagging stick 10 will be cut. The rotating bit 40 will initially compress the material as it drills into the material until sufficient resilient force builds up in the plug-like portion of material being cut to spring up through the interior of the bit. Bit 40 is provided with a cap 45 or other suitable attaching member to which a driving shaft 48 is attached for connection to a prime mover. Shaft 48 is eccentrically mounted on cap 45 so that the axes of shaft 48 and bit 40 are offset by distance B. Thus, as shaft 48 is rotated, bit 40 will rotate eccentrically. The spiraling ridges 26 and troughs 28 are automatically formed on the exterior surface of the stick 10 when the bit is used in this way. It has been found that a certain number of ridges and troughs are needed on the stick to provide air pockets having the proper configuration to produce noise. The number of ridges and troughs formed on the stick, in turn, depends on both the advancing speed and rotational speed of the bit 40.

Foam material, such as polyurethane foam, which has been used to make the stick 10, is cellular in structure. The cells 46, as depicted in FIG. 3, are generally oblong or oval in shape and aligned lengthwise in a common direction, such as horizontally in FIG. 3. It has been discovered that the noise produced by the air pockets 16 is louder when the stick 10 is cut by the bit 40 such that the lengthwise direction of the cells 46 will be transverse to the longitudinal axis of the stick. The reason for this difference in noise level is not known. It can only be theorized that cells oriented in this way permit greater compression of air (possibly because the cells present long narrow columns of air aligned in the direction of impact versus short wide columns of air aligned with the impact direction when the orientation of the cells is rotated ninety degrees).

Parameters which have been found to be of importance to the quality of the tagging stick 10 and its noise producing ability are its tensile strength and density of the material, the number of cells or the cell count of the material, the number of ridges per unit length, the ridge depth, the CLD (Compression Load Deflection) before using the material and length and width of the stick. In addition to polyurethane foam, polyester, polyether foam, or any other suitable foam material may also be used.

Ranges of parameters for manufacture of tagging sticks having the desired stiffness, softness and noise-producing ability are as follows:

| Parameters | Range | Units |
|---|---|---|
| Tensile strength | 25–30 | lb/square inch |
| Density | 1.5–2.5 | lb/cubic foot |
| CLD before using | 0.7–1.1 | lb/square inch |
| Cell count | 25–50 | cells/inch |

-continued

| Parameters | Range | Units |
|---|---|---|
| length | 12–36 | inches |
| stick diameter | 1–5 | inches |
| ridges | 10–30 | per foot |
| ridge depth | 1/32–3/32 | inch |

By way of example, to produce a tagging stick 10, start with a polyurethane foam block within the ranges given above. Cut a foam cylinder with ridges desired from the block by using a tube drill bit with 40 an inside diameter of $1\frac{1}{2}$ inches and an outside diameter of $1\frac{3}{4}$ inches. The relief angle A of incline on the inside surface 43 of the bit is approximately 65 degrees. To acquire 20 ridges per foot, the axial advancing speed of the bit should be approximately 20 feet per minute and the rotational speed should be about 770 rpm. The number of ridges per linear foot may be varied by changing the rotational speed of the bit, the axial advancing speed of the bit, or both. With the rotational speed of the bit held constant, an increase in the axial advancing speed of the bit will result in fewer ridges formed per linear foot. Furthermore, by varying the eccentricity of shaft 48 with respect to bit 40, the depth of the ridges may be varied.

It is thought that the tagging stick of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A tagging stick, comprising:

(a) an elongated body composed of resiliently flexible cellular foam material being stiff enough to allow grasping and swinging by a human hand;

(b) a plurality of indentations formed in the exterior surface of said body to form a plurality of air pocket means for making loud sounds upon impact of said body against an object, said indentation being substantially larger than the cells of said foam material.

2. The tagging stick as recited in claim 1, wherein said body has an elongated cylindrical shape.

3. The tagging stick as recited in claim 1, wherein said material is polyurethane foam.

4. The tagging stick as recited in claim 1, wherein said exterior body surface which defines said pocket means has an undulating configuration composed of alternating ridges and troughs with respect to a cross section along the longitudinal axis of said body.

5. The tagging stick as recited in claim 4, wherein the depth from the bottom of said troughs to the top of said ridges is within the range of 1/32 to 3/32 of an inch.

6. The tagging stick as recited in claim 4, wherein the number of said ridges is within the range of 10 to 30 per foot.

7. The tagging stick as recited in claim 1, wherein said exterior body surface which defines said pocket means has an alternating ridge and trough configuration.

8. The tagging stick as recited in claim 1, wherein said exterior body surface which defines said pocket means has a spiraling continuous ridge and trough configuration.

9. The tagging stick as recited in claim 1, wherein the tensile strength of said cellular foam material is within the range of 25 to 30 pounds per square inch.

10. The tagging stick as recited in claim 1, wherein the density of said cellular foam material is within the range of 1.5 to 2.5 pounds per cubic inch.

11. The tagging stick as recited in claim 1, wherein the cell count of said cellular foam material is within the range of 25 to 50 cells per square inch.

12. A tagging stick, comprising:

(a) an elongated, solid, rod-like, cylindrical body composed of resiliently flexible cellular foam material being stiff enough to allow grasping and swinging by a human hand and soft enough to permit striking against objects and human bodies;

(b) said body having an exterior surface being configured to form a plurality of air pockets which, upon impact of said body against an object, cause compression of the air in said pockets and production of loud sounds;

(c) said exterior body surface which defines said pockets having an undulating configuration composed of alternating ridges and troughs with respect to the longitudinal axis of said body.

13. The tagging stick of claim 12 wherein said alternating troughs and ridges have a depth within the range of 1/32 to 3/32 of an inch and said ridges range in number from 10 to 30 per feet.

14. The tagging stick of claim 12 wherein said cellular foam material have a tensile strength within the range of 25 to 30 pounds per square inch, a density within the range of 1.5 to 2.5 pounds per cubic foot, and a cell count within the range of 25 to 50 cells per square inch.

15. The tagging stick as recited in claim 12, wherein said material is polyurethane foam.

16. The tagging stick as recited in claim 12, wherein said exterior body surface which defines said pockets has a circular alternating ridge and trough configuration.

17. The tagging stick as recited in claim 12, wherein said exterior body surface which defines said pockets has a spiraling continuous ridge and trough configuration.

* * * * *